US007000396B1

(12) United States Patent
Storey

(10) Patent No.: US 7,000,396 B1
(45) Date of Patent: Feb. 21, 2006

(54) CONCENTRIC FIXED DILUTION AND VARIABLE BYPASS AIR INJECTION FOR A COMBUSTOR

(75) Inventor: James Michael Storey, Taylors, SC (US)

(73) Assignee: General Electric Company, Schenectady, NY (US)

( * ) Notice: Subject to any disclaimer, the term of this patent is extended or adjusted under 35 U.S.C. 154(b) by 80 days.

(21) Appl. No.: 10/711,221

(22) Filed: Sep. 2, 2004

(51) Int. Cl.
*F02C 1/00* (2006.01)
*F02G 3/00* (2006.01)

(52) U.S. Cl. ..... 60/752; 60/785; 60/39.23

(58) Field of Classification Search ..... 60/785, 60/794, 795, 723, 728, 752, 758, 760, 39.23, 60/806, 39.822, 777, 722, 732, 39.37
See application file for complete search history.

(56) References Cited

U.S. PATENT DOCUMENTS 2,611,243 A * 9/1952 Huyton ..... 60/39.37
2,679,136 A * 5/1954 Gaubatz ..... 60/800
3,344,601 A * 10/1967 Mieczkowski, Jr. ..... 60/800
4,720,979 A * 1/1988 Mink ..... 60/752
4,875,339 A * 10/1989 Rasmussen et al. ..... 60/757
4,928,481 A * 5/1990 Joshi et al. ..... 60/737
4,944,149 A * 7/1990 Kuwata ..... 60/39.23
5,048,288 A * 9/1991 Bessette et al. ..... 60/226.1
5,154,049 A * 10/1992 Ford et al. ..... 60/796
5,159,807 A * 11/1992 Forestier ..... 60/39.23
5,235,805 A * 8/1993 Barbier et al. ..... 60/39.23
5,351,474 A * 10/1994 Slocum et al. ..... 60/39.23
5,687,572 A * 11/1997 Schrantz et al. ..... 60/753
5,735,126 A * 4/1998 Schulte-Werning ..... 60/732
5,826,429 A * 10/1998 Beebe et al. ..... 60/723
5,829,245 A * 11/1998 McQuiggan et al. ..... 60/806
5,950,417 A * 9/1999 Robertson et al. ..... 60/776
6,276,142 B1 * 8/2001 Putz ..... 60/752
6,331,110 B1 * 12/2001 Steber et al. ..... 431/352
6,449,956 B1 * 9/2002 Kolman et al. ..... 60/777
6,568,188 B1 5/2003 Kolman et al.
6,701,715 B1 * 3/2004 Anderson et al. ..... 60/782
6,729,141 B1 * 5/2004 Ingram ..... 60/804

* cited by examiner

*Primary Examiner*—William H. Rodriguez
(74) *Attorney, Agent, or Firm*—Cantor Colburn LLP

(57) ABSTRACT

A combustor for a gas turbine includes a combustor body having an aperture and a casing enclosing the combustor body and defining a passageway therebetween for carrying compressor discharge air. There is at least one injection tube for supplying an amount of the compressor discharge air into the combustor body and the injection tube is disposed between the aperture and through the casing. A collar is disposed at the passageway and surrounds the injection tube so that the injection tube passes through the collar. A gap is disposed between the collar and the injection tube. The collar has a plurality of openings. A method for quenching combustion in a gas turbine includes supplying a fixed amount of compressor discharge air into a body of a combustor of the gas turbine and supplying a variable amount of compressor discharge air into the body. The fixed amount of compressor discharge air is disposed concentrically around the variable amount of compressor discharge air.

16 Claims, 6 Drawing Sheets

CONCENTRIC FIXED DILUTION AND VARIABLE BYPASS AIR INJECTION FOR A COMBUSTOR

BACKGROUND OF THE INVENTION

Gas turbine manufacturers are currently involved in research and engineering programs to produce new gas turbines that will operate at high efficiency without producing undesirable air polluting emissions. The primary air polluting emissions usually produced by gas turbines burning conventional hydrocarbon fuels are oxides of nitrogen, carbon monoxide and unburned hydrocarbons.

Catalytic reactors are generally used in gas turbines to control the amount of pollutants as a catalytic reactor burns a fuel and air mixture at lower temperatures, thus reduces pollutants released during combustion. As a catalytic reactor ages, the equivalence ratio (actual fuel/air ratio divided by the stochiometric fuel/air ratio for combustion) of the reactants traveling through the reactor needs to be increased in order to maximize the effectiveness of the reactor with time.

BRIEF DESCRIPTION OF THE INVENTION

Exemplary embodiments of the invention include a combustor for a gas turbine that includes a combustor body having an aperture and a casing enclosing the combustor body and defining a passageway therebetween for carrying compressor discharge air. There is at least one injection tube for supplying an amount of the compressor discharge air into the combustor body and the injection tube is disposed between the aperture and through the casing. A collar is disposed at the passageway and surrounds the injection tube so that the injection tube passes through the collar. A gap is disposed between the collar and the injection tube. The collar has a plurality of openings.

Further exemplary embodiments of the invention include a method for quenching combustion in a gas turbine that includes supplying a fixed amount of compressor discharge air into a body of a combustor of the gas turbine and supplying a variable amount of compressor discharge air into the body. The fixed amount of compressor discharge air is disposed concentrically around the variable amount of compressor discharge air and is fed by the plurality of said openings in the floating collars at each of the injection locations into the body.

DETAILED DESCRIPTION OF THE INVENTION

Gas turbines generally include a compressor section, a combustion section and a turbine section. The compressor section is driven by the turbine section typically through a common shaft connection. The combustion section typically includes a circular array of circumferentially spaced combustors. A fuel/air mixture is burned in each combustor to produce the hot energetic gas, which flows through a transition piece to the turbine section. For purposes of the present description, only one combustor is discussed and illustrated, it being appreciated that all of the other combustors arranged about the turbine are substantially identical to one another.

Figure 1:
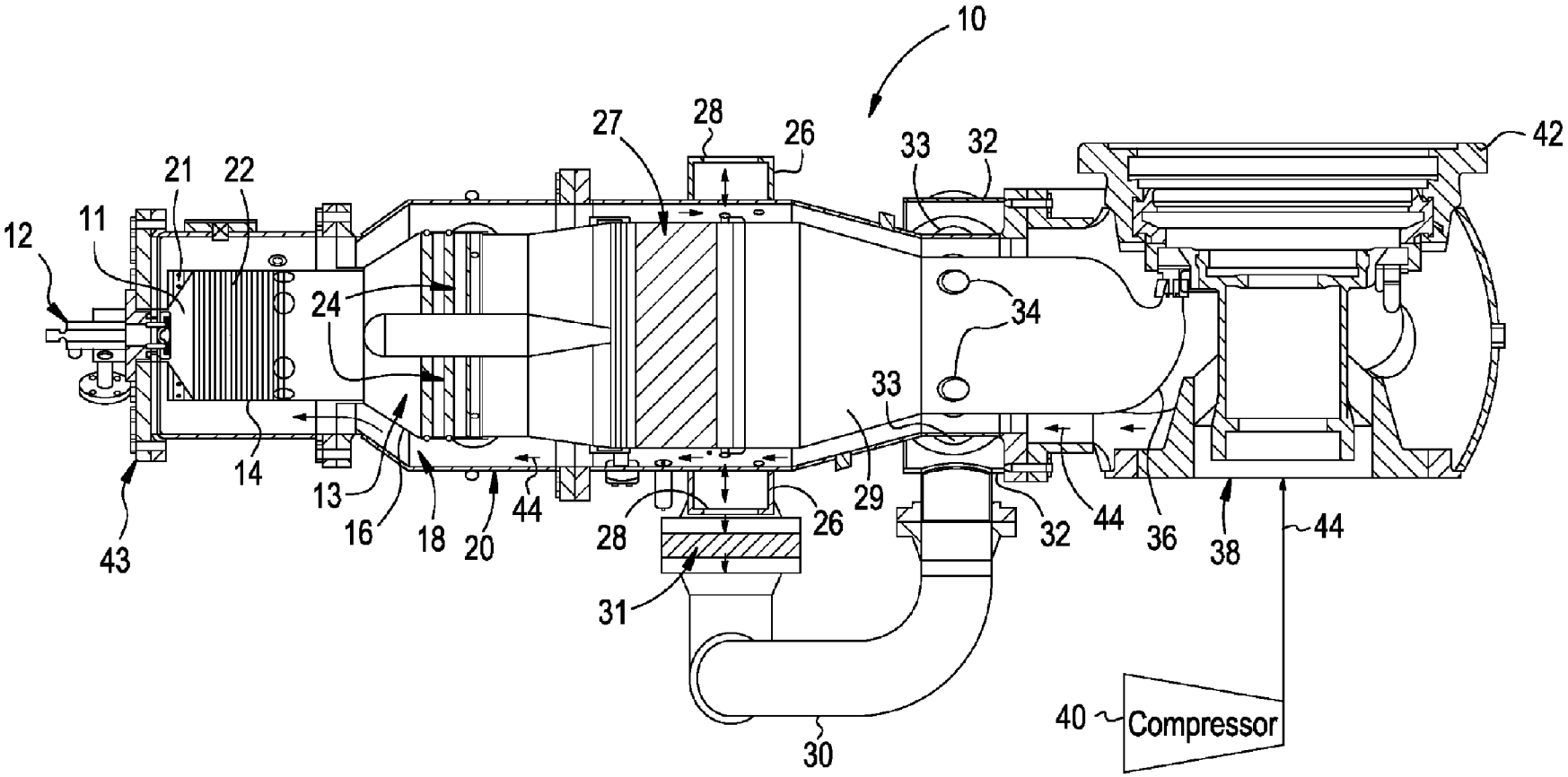
FIG. 1 is a schematic cross-sectional illustration of a combustor forming a part of a gas turbine.

Referring now to FIG. 1, there is shown a combustor generally indicated at 10 for a gas turbine including a fuel injector assembly 12 having a single nozzle or a plurality of fuel nozzles (not shown) and an inner liner assembly 13 that includes a first reaction zone in combustion chamber 14, a cylindrical body assembly 16, which is part of a main fuel premixer (MFP) assembly 24, and a main combustion chamber 29. The fuel injector assembly 12 also includes a casing 20 enclosing the body assembly 16 thereby defining a passageway 18, preferably an annulus 18 therebetween. An ignition device (not shown) is provided and preferably comprises an electrically energized spark plug to ignite a fuel air mixture in the preburner assembly 11 during turbine startup. Discharge air 44 received from a compressor 40 via an inlet duct 38 flows through the annulus 18 and enters the preburner assembly 11 and body 16 through a plurality of holes 22 provided on the first combustion chamber 14.

Compressor discharge air 44 enters body 16 under a pressure differential across the cap assembly 21 to mix with fuel from the fuel injector assembly 12. Combustion of this mixture occurs in a first combustion chamber or first reaction zone 14 within the body 16 of the preburner assembly 11 thus raising the temperature of the combustion gases to a sufficient level for the catalyst 27 to react. Combustion air from the first combustion chamber 14 flows through the main fuel premixer (MFP) assembly 24 and then through catalyst 27 into the main combustion chamber or main reaction zone 29 for combustion. Additional fuel is pumped into the MFP assembly 24 to mix with hot gases, exiting the first combustion chamber 14, thus producing a combustion reaction in the main combustion chamber 29. Accordingly, the hot gases of combustion pass through a transition piece 36 to drive the turbine (an inlet section of the turbine is shown at 42).

Figure 2:
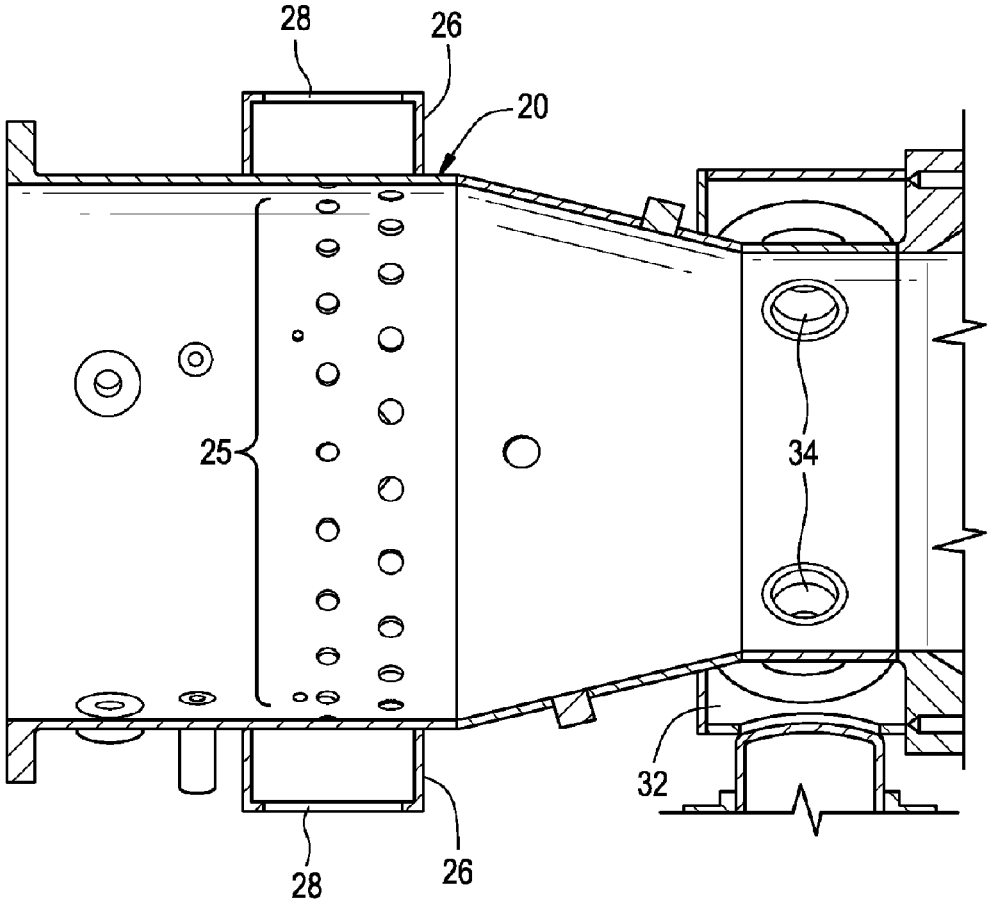
FIG. 2 shows a section of the combustor casing of FIG. 1 having an array of openings for extracting compressor discharge air.

A predetermined amount of the compressor discharge air 44 is extracted from the annulus 18 into a manifold 26 via an array of openings 25 (FIG. 2) located in casing 20 and leading into an opening 28 which sealingly mates with one end of a bypass conduit 30, while a second end of conduit 30 leads into an injection manifold 32. A valve 31 regulates the amount of air supplied to manifold 32 from manifold 26. Air 44 received in manifold 32 is injected by a plurality of injection tubes 33 into body assembly 16, bypassing catalyst 27. It is noted that while the exemplary embodiment shows a circular tube for the injection tubes 33, injection tubes 33 may be any shape and does not have to be circular so long as the tube is hollow so as to allow the air to travel through the tube. Each of the injection tubes 33 and manifold 32 are located substantially in a common axial plane normal to the combustor centerline (spaced around the circumference of body assembly 16 in the same plane).

Figure 3:
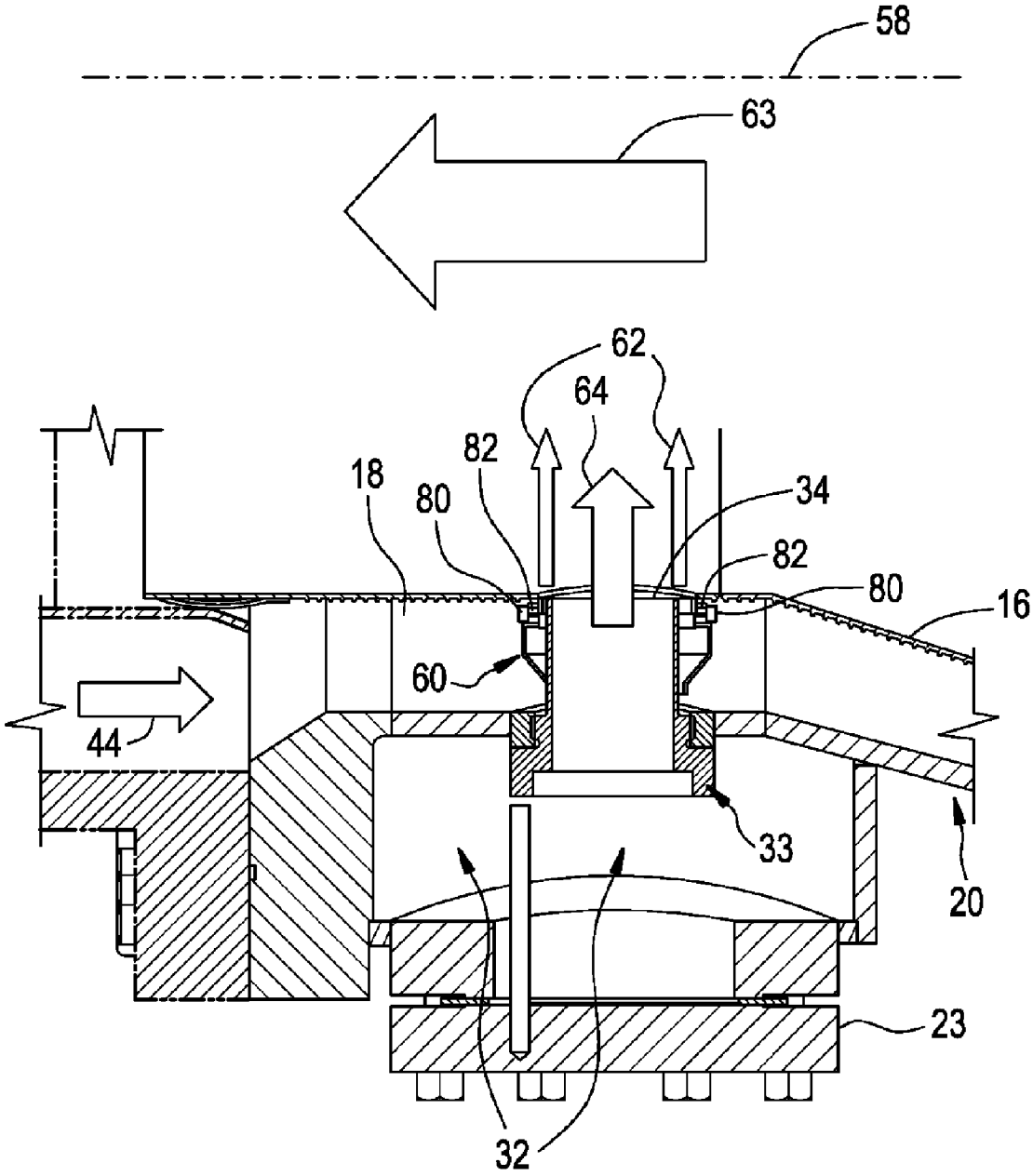
FIG. 3 is a detailed illustration of a bypass injection scheme.

Referring to FIG. 3, each injection tube 33 opens into body 16 through apertures 34. Removable flange covers 23 are provided on the injection manifold in substantial radial alignment with the respective injector tubes 33 affording access to the tubes. The injection tubes 33 are installed from the outside of the injection manifold 32 at circumferentially spaced locations about the casing 20 and the body 16 through flange covers 23. In an exemplary embodiment, there are four injection tubes 33 spaced about 90 degrees apart about the casing 20. The injected air cools the reaction and quenches the combustion process.

Figure 4:
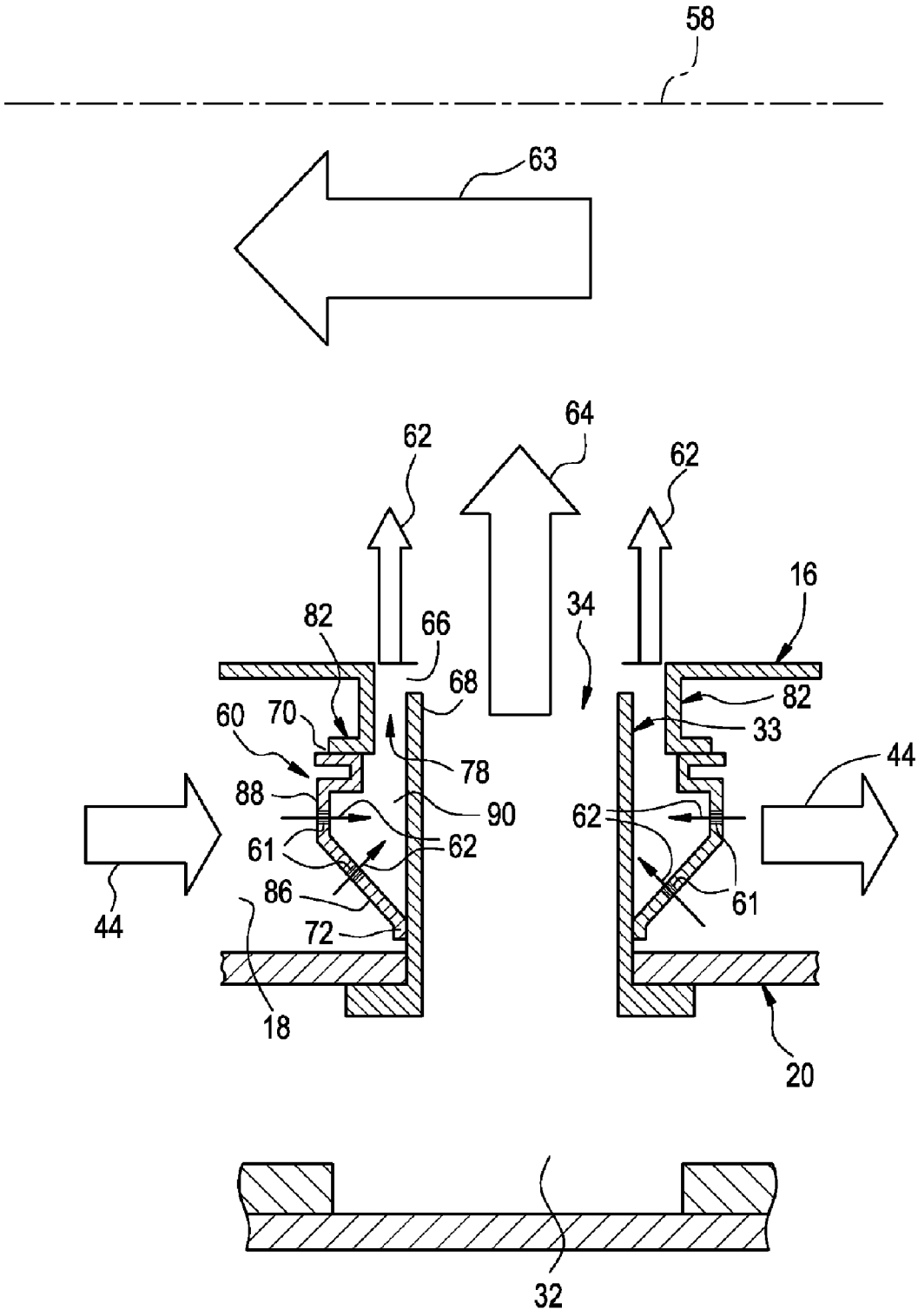
FIG. 4 is a detailed illustration of a cross-section of a floating collar as assembled in the bypass injection scheme.
Figure 5:
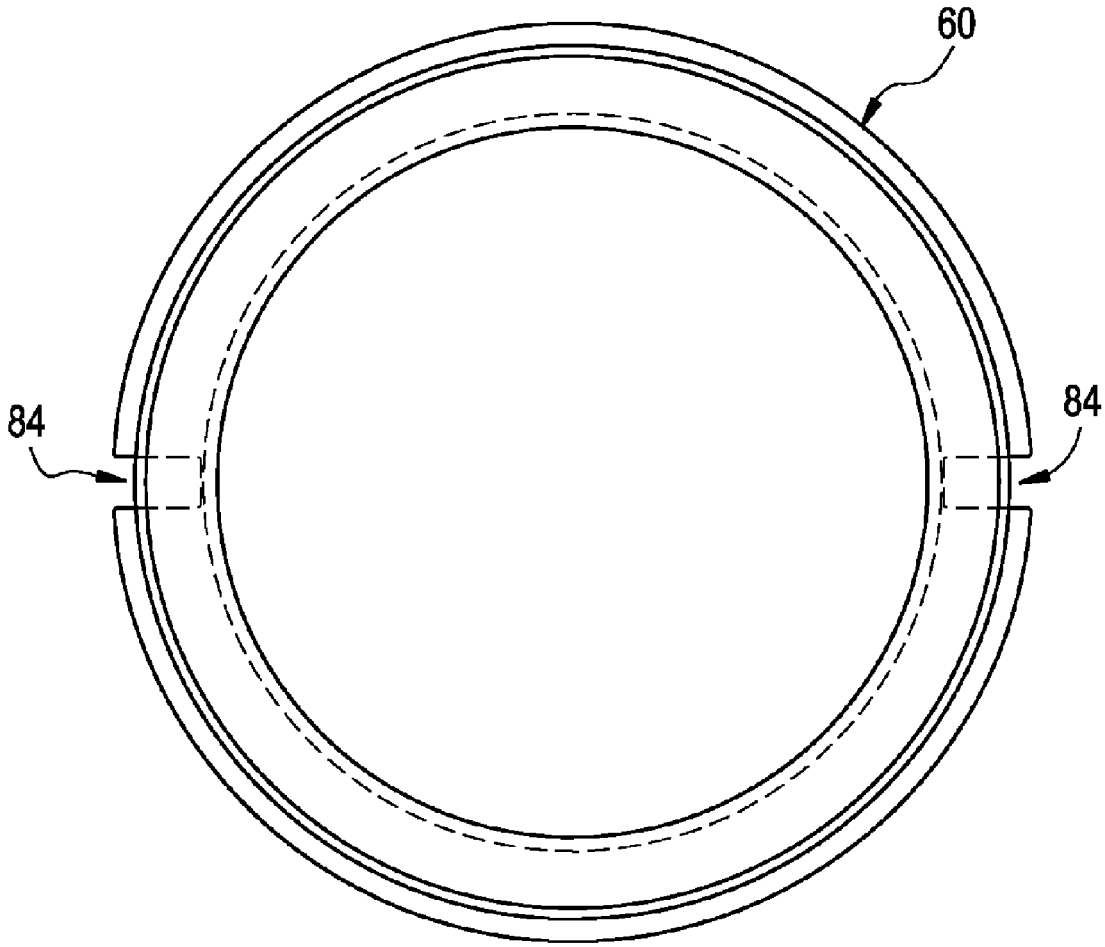
FIG. 5 is a front view of the floating collar of FIG. 4.

Referring to FIGS. 3 and 4, a cross-section of half of the combustor is illustrated. This becomes apparent with reference to the combustor centerline, shown at number 58. Each of the injection tubes 33 interface with the body 16 through a floating collar 60 having openings 61 (e.g. holes, slots, etc.) (also referred to as collar openings). Once the compressor discharge air 44 reaches the floating collar 60, the air 44 is defined as a predetermined amount of air 62 and a variable amount of air 64. Floating collar 60 allows the predetermined amount of air 62 from the passageway 18 to be constantly injected into the hot gas path 63 with the combustor. The floating collar 60 also allows the variable amount of air 64, which travels through the bypass conduit 30 and is controlled by the valve 31 (see FIG. 1), to be injected into the hot gas path 63 of the combustor. Thus, the floating collar 60 allows a variable amount of air 64 and a fixed amount of air 62, which is located in an annulus concentrically around the outside of the variable amount of air 64, to be injected into the hot gas path 63.

The injection tube 33 is inserted through the casing 20 and the passageway 18 to the body 16. The injection tube 33 is connected, e.g., threaded, to the casing 20. In an exemplary embodiment, there is a space 66 between the body 16 and an end 68 of the injection tube 33. The space 66 exists so that during operation of the combustor when the injection tube 33 and body 16 heat up and expand, the injection tube 33 does not extend past the body 16.

The floating collar 60 is mounted to the body 16 at a first end 70 and rests against the injection tube at a second end 72. The collar 60 is a cylindrical member that surrounds the injection tube 33 at the passageway 18. The floating collar 60 has a predetermined number of openings. The number and size of openings can be varied so as to determine the amount of air 62 (fixed dilution flow) that will be constantly supplied to the combustor. In an exemplary embodiment, the openings 61 are approximately 0.6 centimeters to approximately 1.3 centimeters in diameter and are aligned so that there are two rows of 15 to 20 openings equally spaced around the entire collar 60 in an angled section 86 of collar 60 and one row of 15 to 20 openings equally spaced around the entire collar in a straight section 88 of collar 60. However, the hole size, number, and location will vary depending on the amount of fixed dilution that would be desirable or required.

In an exemplary embodiment, the floating collar 60 is mounted to the body 16 through a retaining clip 80. There can also be two retaining clips 80 located on either side of the floating collar 60. The retaining clip 80 fits over an extension 82 of the body 16 and into a slot 84 at the first end 70 of the floating collar 60. The retaining clip 80 is welded into place at the extension 82. The retaining clip 80 limits the movement of the floating collar 60 by keeping the floating collar 60 from spinning and from lifting off of the extension 82 of the body 16.

In addition, when the injection tube is inserted through passageway 18 to body 16, the aperture 34 in body 16 is larger than end 68 of injection tube, which produces a gap 78. The aperture 34 is larger than end 68 because of the thermal expansion that occurs in body 16 when the combustor is operating. Thermal expansion will also cause the injection tube 33 to be in different positions within aperture 34 depending on the state of the combustor. Thus, at cold conditions, the injection tube will be in a certain position relative to the aperture 34 and at full operation, the injection tube will be at a different position relative to the aperture 34. At full operation, the centerline of the injection tube 33 will be located at the centerline of the aperture 34. In the cold condition, the centerline of the injection tube 33 will be offset from the centerline of the aperture 34.

Moreover, the floating collar covers up the gap 78 so that the air 44 does not leak into the combustor, except through the controlled condition of the openings 61. In addition, because the air 62 passes through the openings 61 in floating collar 60 into a cavity 90, there is a plenum that is created that feeds the fixed concentric dilution, which surrounds the variable bypass dilution. The plenum provides a uniform, controlled flow of air to the gap 78 (or annulus) around the outside of the injection tube 33, which is then injected into the combustor flow in the form an annular jet.

The advantage of having the floating collar 60 configured as such is that the collar 60 provides for a controlled amount of fixed concentric dilution flow to be injected around the variable bypass flow regardless of the position of the injection tube 33 relative to the aperture 34. By having the fixed concentric dilution flow, the necessary range of movement for the valve 31 to actuate is less than if the fixed concentric dilution was included in the flow through the valve 31. Thus, the properly sized valve 31 can be operated within its highest accuracy range, which allows for fine tuning (better control) of the variable bypass flow. Also, by having the fixed amount of dilution flow facilitated by the floating collar 60, the necessary size of the manifolds 26 & 32, the bypass conduit 30, and the valve 31 are reduced since they need to accommodate only the variable flow. The fixed concentric dilution flow allows for increased consistency in jet mixing with the main combustor flow 63 over the variable bypass flow range.

Figure 6:
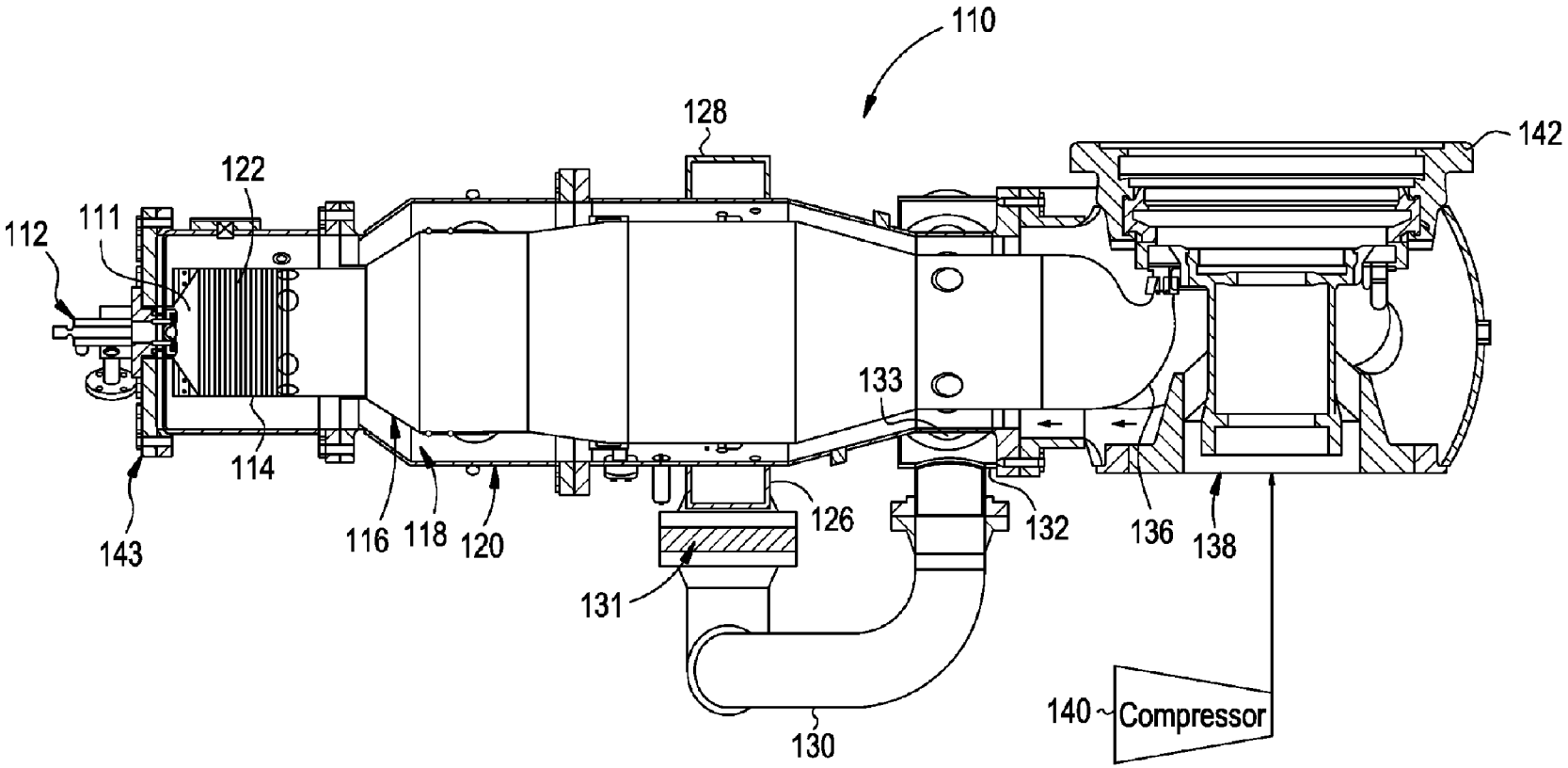
FIG. 6 illustrates another embodiment of the invention in which a catalytic reactor is removed from the combustor.

Referring to FIG. 6, a second embodiment is illustrated wherein like elements as in the combustor of FIG. 1 are indicated by like reference numerals preceded by the prefix "1". Here, the combustor 110 comprises a combustion chamber or reaction zone 114 where main combustion occurs. Catalyst 27 and MFP assembly 24 are absent in this embodiment. Here, compressor discharge air from annulus 118 flows into manifold 126, and from manifold 126 via conduit 130 flows into body 116 through injection tubes 133 bypassing the combustion chamber 114. Further, the total amount of fuel supplied to mix with compressor discharge air is injected through the fuel injector assembly 112 in the absence of the catalyst and MFP assembly. It will be appreciated that the location of the combustion chamber 114 need not necessarily lie in close proximity to the fuel injector assembly 112. Rather it may be located within body 116 between end member 143 and manifold 132. Likewise, manifold 132 may be appropriately located along casing 120 to inject air into body 116 provided the combustion chamber is bypassed in order to quench the combustion process. The same floating collar 60 (see FIGS. 2–5) can be incorporated at injection tubes 133 of combustor 110.

Thus, the present invention has the advantages of maximizing the effectiveness of the catalytic reaction, thereby increasing the efficiency of the combustor. The present invention further provides a simple means of controlling the combustion process in a non-catalytic combustor by providing for air control capability to the combustion zone independent of machine (turbine) operation.

In addition, while the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A combustor for a gas turbine comprising:

a combustor body having an aperture;

a casing enclosing said body and defining a passageway therebetween for carrying compressor discharge air;

at least one injection tube for supplying an amount of said compressor discharge air into said combustor body, said injection tube is disposed between said aperture and through said casing; and a collar disposed at said passageway, wherein said collar surrounds said injection tube so that said injection tube passes through said collar and a gap is disposed between said collar and said injection tube, said collar having a plurality of openings.

2. The combustor of claim 1, wherein said plurality of openings are arranged and sized so that a predetermined amount of said compressor discharge air is constantly supplied into said combustor body.

3. The combustor of claim 1, wherein each of said plurality of openings are about 0.6 centimeter to about 1.3 centimeter in diameter.

4. The combustor of claim 1, wherein each of said plurality of openings are arranged in equally spaced rows around said collar.

5. The combustor of claim 1, wherein said collar having a first end and a second end, said first end mounted to said combustor body and said second end extending to said injection tube.

6. The combustor of claim 5, further comprising a retaining clip that connects said collar to said body at said first end.

7. The combustor of claim 1, further comprising a space between an outer diameter of said aperture of said body and an end of said injection tube.

8. The combustor of claim 1, wherein said aperture is larger than an outer span of said injection tube.

9. The combustor of claim 1, wherein said collar includes a straight section that is mounted to said body and a sloped section that extends to said injection tube.

10. The combustor of claim 9, wherein said straight section includes said openings and said sloped section includes said openings.

11. The combustor of claim 1, further comprising a catalytic reactor disposed in said body for controlling pollutants released during combustion.

12. The combustor of claim 1, further comprising a reaction zone within said combustor body for main combustion of fuel and air.

13. The combustor of claim 1, wherein said amount of said compressor discharge air from said at least one injection tube is variable and said plurality of openings supplies a fixed amount of said compressor discharge air into said compressor body.

14. A combustor for a gas turbine comprising:

a combustor body having an aperture;

a casing enclosing said body and defining a passageway therebetween for carrying compressor discharge air;

at least one injection tube for supplying a variable amount of said compressor discharge air into said combustor body, said injection tube is disposed between said aperture and through said casing; and means for supplying a fixed amount of said compressor discharge air into said body, said means for supplying said fixed amount of said compressor discharge air disposed circumferentially around said at least one injection tube for supplying a variable amount of said compressor discharge air.

15. A combustor for a gas turbine comprising:

a combustor body having an aperture;

a casing enclosing said body and defining a passageway therebetween for carrying compressor discharge air;

at least one injection tube for supplying a variable amount of said compressor discharge air into said combustor body, said injection tube is disposed between said aperture and through said casing; and a collar disposed at said passageway and mounted to said combustor body and extending to said injection tube, said collar configured to supply a fixed amount of said compressor discharge air to said body.

16. A method for quenching combustion in a gas turbine comprising: a combustor body having an aperture; a casing enclosing said body and defining a passageway therebetween for carrying compressor discharge air; at least one injection tube disposed between said aperture and through said casing; and a collar disposed concentrically around said at least one injection tube, the method comprising:

supplying a fixed amount of said compressor discharge air into said combustor body through said collar; and supplying a variable amount of said compressor discharge air into said combustor body through said at least one injection tube, said fixed amount of said compressor discharge air disposed concentrically around said variable amount of said compressor discharge air.

* * * * *